US009024821B2

(12) United States Patent
Chou

(10) Patent No.: US 9,024,821 B2
(45) Date of Patent: May 5, 2015

(54) ANTENNA STRUCTURE

(71) Applicant: Wistron Corp., New Taipei (TW)

(72) Inventor: Chen-Yu Chou, New Taipei (TW)

(73) Assignee: Wistron Corp., New Taipei (TW)

( * ) Notice: Subject to any disclaimer, the term of this patent is extended or adjusted under 35 U.S.C. 154(b) by 98 days.

(21) Appl. No.: 13/685,614

(22) Filed: Nov. 26, 2012

(65) Prior Publication Data

US 2013/0300611 A1 Nov. 14, 2013

(30) Foreign Application Priority Data

May 11, 2012 (TW) ..... 101116790 A

(51) Int. Cl.
*H01Q 1/38* (2006.01)
*H01Q 1/36* (2006.01)
*H01Q 9/27* (2006.01)

(52) U.S. Cl.
CPC ... *H01Q 1/36* (2013.01); *H01Q 9/27* (2013.01)

(58) Field of Classification Search
USPC ..... 343/700 MS, 895
See application file for complete search history.

(56) References Cited

U.S. PATENT DOCUMENTS

| | | | | |
|---|---|---|---|---|
| 4,115,783 | A | 9/1978 | Reggia | |
| 6,281,794 | B1 * | 8/2001 | Duan et al. | 340/572.1 |
| 2005/0280599 | A1 * | 12/2005 | Le Goff et al. | 343/895 |
| 2009/0033565 | A1 * | 2/2009 | Yen et al. | 343/702 |
| 2011/0128185 | A1 * | 6/2011 | Tsai et al. | 343/700 MS |
| 2011/0234471 | A1 | 9/2011 | Tanabe et al. | |

FOREIGN PATENT DOCUMENTS

| | | | |
|---|---|---|---|
| CN | 101872892 | A | 10/2010 |
| EP | 0969547 | A2 | 1/2000 |
| WO | WO 2011/128243 | A1 | 10/2011 |

OTHER PUBLICATIONS

China Patent Office, Office Action, Patent Application Serial No. 201210164086.2, Dec. 15, 2014, China.

China Patent Office, Office Action, Patent Application Serial No. 201210164086.2, Nov. 4, 2014, China.

Taiwan Patent Office, Office Action, Patent Application Serial No. 101116790, Jan. 28, 2015, Taiwan.

* cited by examiner

*Primary Examiner* — Dieu H Duong

(57) ABSTRACT

An antenna structure is provided. The antenna structure includes a circular area, a feed point, a first radiator and a second radiator. The circular area includes a first region and a second region. The feed point is disposed at a center of the circular area. The first radiator is coupled to the feed point, and winds outwardly in one direction in the shape of a semi-circular arch in the first region. The second radiator is coupled to the feed point, and winds outwardly in an opposite direction to windings of the first radiator in the shape of a semi-circular arch in the second region.

12 Claims, 12 Drawing Sheets

ANTENNA STRUCTURE

CROSS REFERENCE TO RELATED APPLICATIONS

This application claims priority of Taiwan Patent Application No. 101116790, filed on May 11, 2012, the entirety of which is incorporated by reference herein.

BACKGROUND OF THE INVENTION

1. Field of the Invention

The present invention relates to an antenna structure, and in particular relates to an antenna structure utilized for near field communication (NFC) tests.

2. Description of the Related Art

For communication tests, test antenna structures are utilized for testing the noise generated from electronic devices to determine whether the electronic devices meet required standards. Additionally, test antenna structures are utilized to generate wireless signals to be received by the electronic devices to determine whether the receiving function of the electronic devices is normal.

Conventionally, an isolation room of 20 square meters is provided for the communication test. However, commercially available, and most used antennas are far field antennas, which cannot be utilized for isolation rooms. Therefore, an antenna structure which can be utilized for near field communication (NFC) tests is required; particularly an antenna structure which can perform test functions on a stage which is shorter than 80 centimeters.

BRIEF SUMMARY OF THE INVENTION

In one embodiment of the invention, an antenna structure is provided. The antenna structure includes a circular area, a feed point, a first radiator and a second radiator. The circular area includes a first region and a second region. The feed point is disposed at a center of the circular area. The first radiator is coupled to the feed point, and winds outwardly in one direction in the shape of a semicircular arch in the first region. The second radiator is coupled to the feed point, and winds outwardly in an opposite direction to windings of the first radiator in the shape of a semicircular arch centrally in the second region.

In another embodiment of the invention, an antenna structure is provided for transmitting a wireless signal. The antenna structure comprises a substrate, a feed point and a radiator. The substrate comprises a circular area. The feed point is disposed at a center of the circular area. The radiator is coupled to the feed point, wherein the radiator comprises a body portion and a tail portion, and the tail portion is connected to the body, and a surface current travels from the feed point, along an edge of the body portion and an edge of the tail portion edge to a free end of the tail portion.

In further another embodiment of the invention, an antenna structure is provided for transmitting a wireless signal. The antenna structure comprises a substrate, a feed point and a radiator. The substrate comprises a circular area. The feed point is disposed at a center of the circular area. The radiator surrounds and is coupled to the feed point, wherein the radiator comprises a body, a first arm and a second arm, and the first arm and the second arm extend from the body. The first arm extends along a peripheral of the circular portion, and the second arm extends toward a direction opposite to the first arm. A surface current travels from the feed portion and passes through the body and the first arm to a free end of the first arm.

The antenna structure of the embodiments of the invention has decreased dimensions, and due to the antenna structure, results in improved NFC test effects and more optimal radiation patterns.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
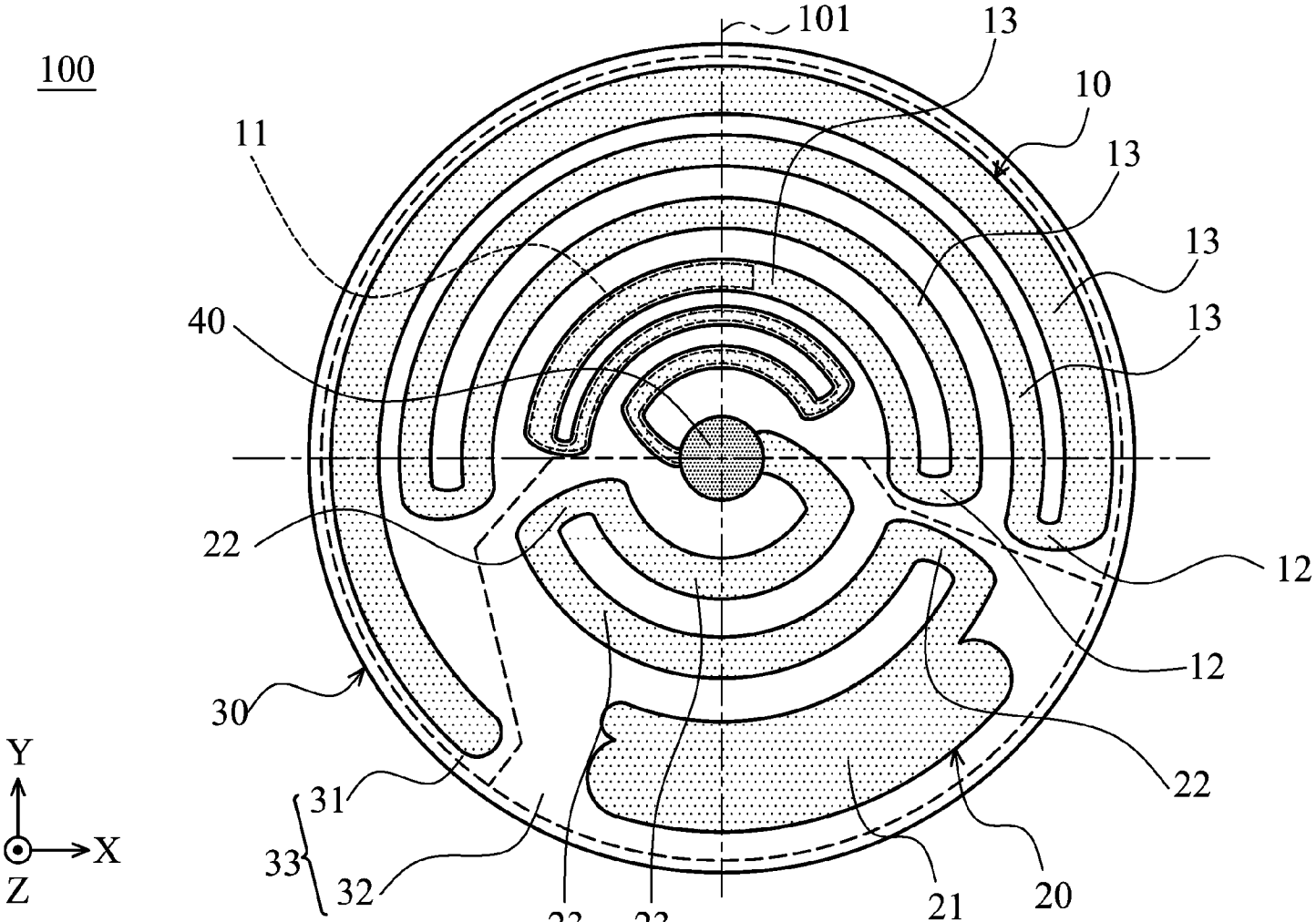
FIG. 1 shows an antenna structure of a first embodiment of the invention.

FIG. 1 shows an antenna structure 100 of a first embodiment of the invention, comprising a substrate 30, a feed point 40, a first radiator 10 and a second radiator 20. In this embodiment, the substrate 30 is circular, and a circular area 33 is located on the substrate 30. The circular area 33 comprises a first region 31 and a second region 32. The feed point 40 is located at the center of the circular area 33. The first radiator 10 is coupled to the feed point 40, and winds outwardly in one direction in the shape of a semicircular arch in the first region 31. The second radiator 20 is coupled to the feed point 40, and winds outwardly in one direction in the shape of a semicircular arch in the second region 32.

In one embodiment, the first radiator 10 and the second radiator 20 are in a microstrip structure, and extend on the substrate 30.

In this embodiment, the antenna structure 100 is adapted to transmit a high band signal and a low band signal, and the first radiator 10 comprises a high band section 11, the total path length (including the high band section 11) of the first radiator 10 is about a quarter of a wavelength of the low band signal, and the path length of the high band section 11 is about one of eight of a wavelength of the high band signal.

In detail, the first radiator 10 comprises a plurality of first bending portions 12 and a plurality of first extending portions 13, and the first bending portions 12 extend in the radial direction, the first extending portions 13 extend in the circumferential direction, and at least one of the first bending portions 12 connects the neighboring first extending portions 13.

In this embodiment, the path length of the second radiator 20 is about a quarter of the wavelength of the high band signal. The second radiator 20 further comprises a coupling portion 21 formed at an end of the second radiator 20. The line width of the coupling portion 21 is greater than a line width of the first radiator 10. The coupling portion 21 extends along a peripheral of the circular portion 33. In detail, the second radiator 20 comprises a plurality of second bending portions 22 and a plurality of second extending portions 23, and the second bending portions 22 extend in the radial direction, and the second extending portions 23 extend in the circumferential direction, and at least one of the second bending portions 22 connects the neighboring second extending portions 23.

In this embodiment, the first radiator 10 winds outwardly in one direction in the shape of a semicircular arch centrally about a first swinging center line 101, and the second radiator 20 winds outwardly in an opposite direction to windings of the first radiator 10 in the shape of a semicircular arch centrally about the first swinging center line 101.

In the embodiment, the antenna structure is a monopole antenna. However, the invention is not limited thereby. For example, in the embodiment of the invention, the radiator can be grounded to become an antenna structure of another type.

Figure 2A:
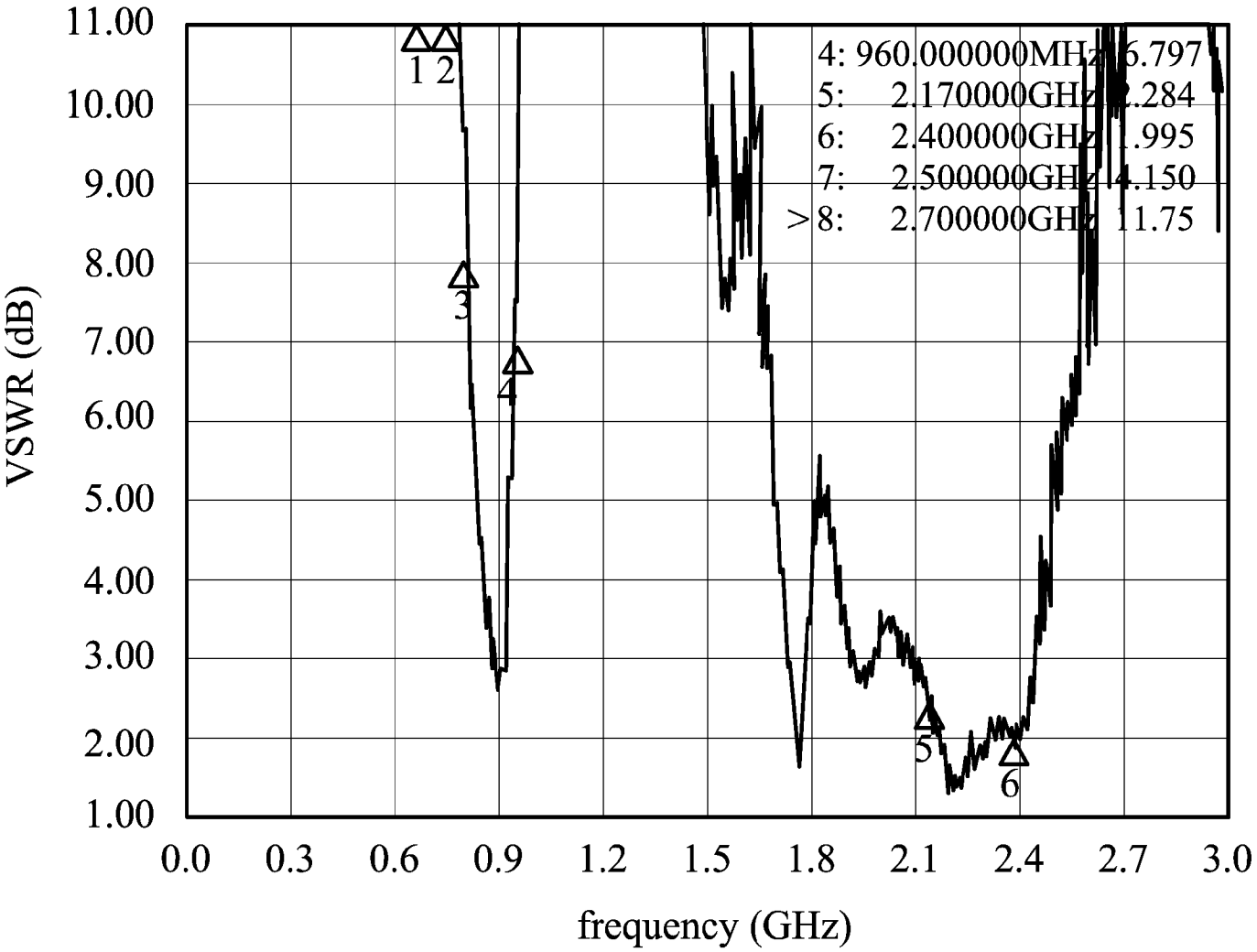
FIG. 2A shows the voltage standing wave ratio of the antenna structure of the first embodiment of the invention.
Figure 2B:
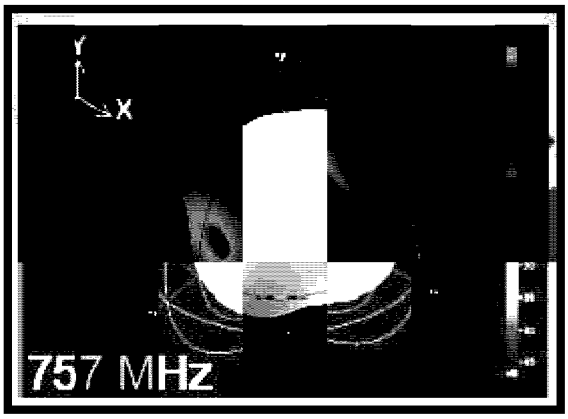
FIGS. 2B, 2C and 2D show the radiation pattern of the antenna structure of the first embodiment of the invention.
Figure 2C:
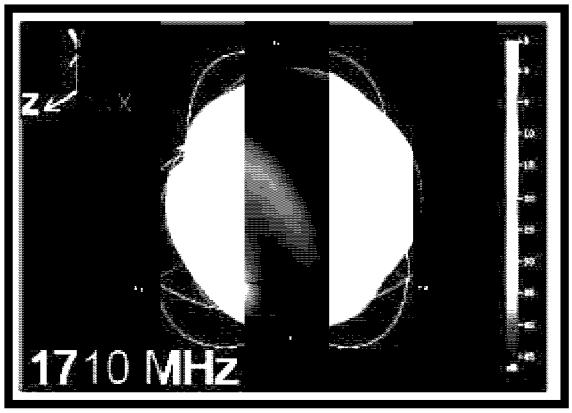
Figure 2D:
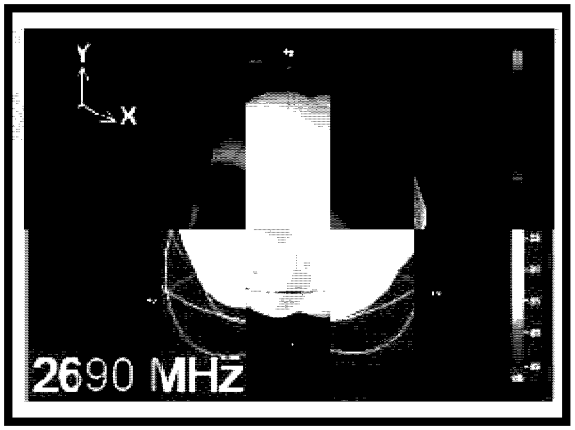
Figure 2E:
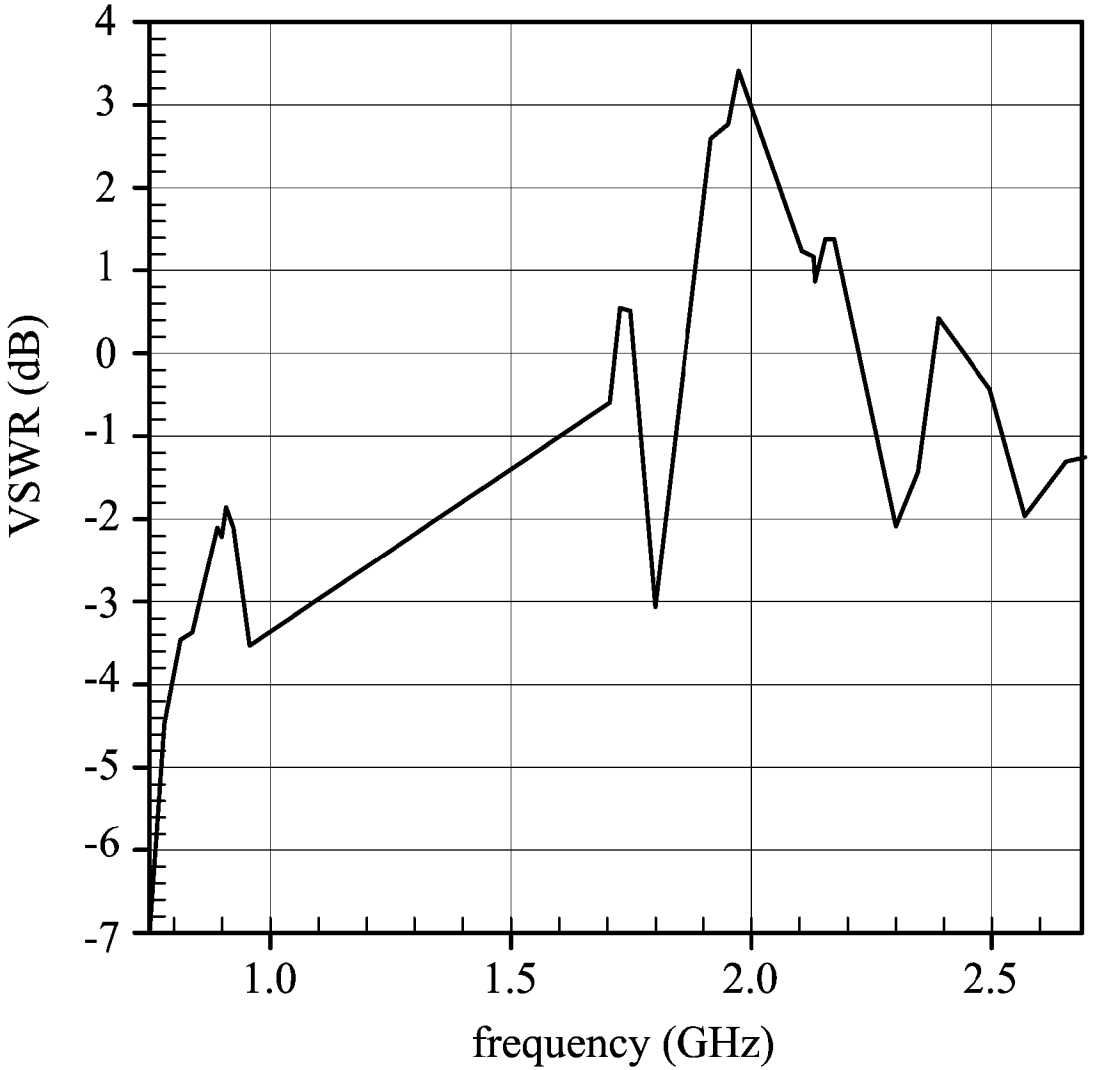
FIG. 2E shows the gain value of the antenna structure of the first embodiment of the invention.

The antenna structure of the embodiments of the invention has decreased dimensions, and due to the antenna structure, results in improved NFC test effects and more optimal radiation patterns. FIG. 2A shows the voltage standing wave ratio of the antenna structure of the first embodiment of the invention. As shown in FIG. 2A, the antenna structure 100 of the embodiment of the invention results in improved NFC test effects in the bands of 710 MHz~960 MHz (lower band) and of 1.7 GHz~2.17 GHz (higher band). In this embodiment, the second radiator 20 is utilized as a compensate element to improve the performance of the antenna structure 100 in the bands of 1.7 GHz~2.17 GHz (higher band). FIGS. 2B, 2C and 2D show the radiation pattern of the antenna structure of the first embodiment of the invention, wherein the antenna structure of the first embodiment results in improved radiation patterns on the Y axis. FIG. 2E shows the gain value of the antenna structure of the first embodiment of the invention, wherein the peak value thereof conforms to the Wireless Fidelity (WIFI) standard.

Figure 3:
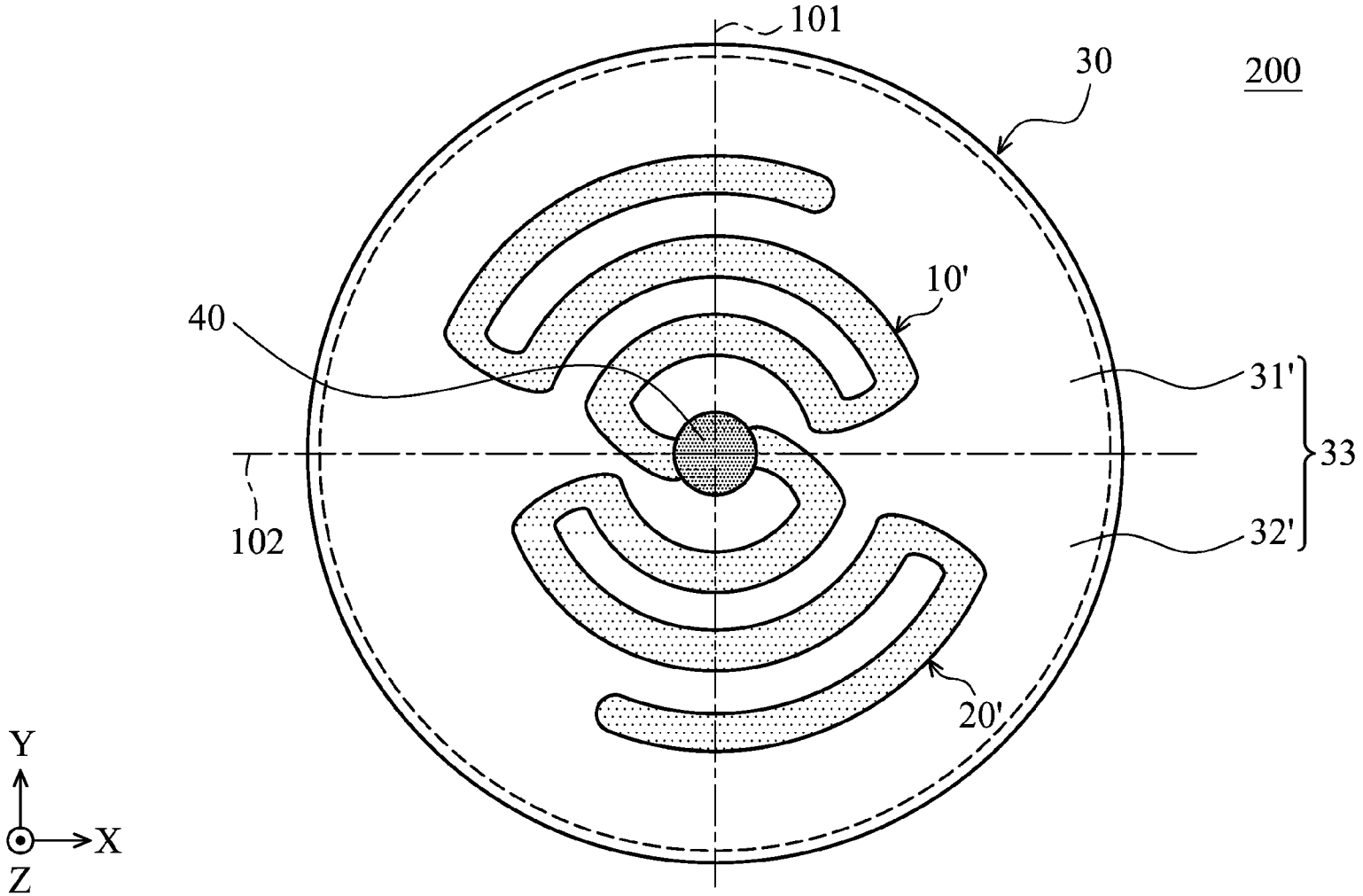
FIG. 3 shows an antenna structure of a second embodiment of the invention.

FIG. 3 shows an antenna structure 200 of a second embodiment of the invention, comprising a substrate 30, a feed point 40, a first radiator 10' and a second radiator 20'. In this embodiment, the substrate 30 is circular. A circular area 33 is located on the substrate 30, and is divided into a first region 31' and a second region 32' by a central line 102. The feed point 40 is located at the center of the circular area 33. The first radiator 10' is coupled to the feed point 40, and winds outwardly in one direction in the shape of a semicircular arch in the first region 31'. The second radiator 20' is coupled to the feed point 40, and winds outwardly in one direction in the shape of a semicircular arch in the second region 32'.

In this embodiment, the first radiator 10' winds outwardly in one direction in the shape of a semicircular arch centrally about a first swinging center line 101, and the second radiator 20' winds outwardly in an opposite direction to windings of the first radiator 10' in the shape of a semicircular arch centrally about the first swinging center line 101.

The antenna structure 200 of the embodiment of the invention is characteristic in that the first region 31' and the second region 32' are semicircular and are symmetrically relative to the central line 102. The antenna 200 is utilized to transmit a wireless signal. The first radiator 10' is symmetric to the second radiator 20' relative to the central line 102. The length of the first radiator 10' and the length of the second radiator 20' are about a quarter of the wavelength of the wireless signal.

Figure 4A:
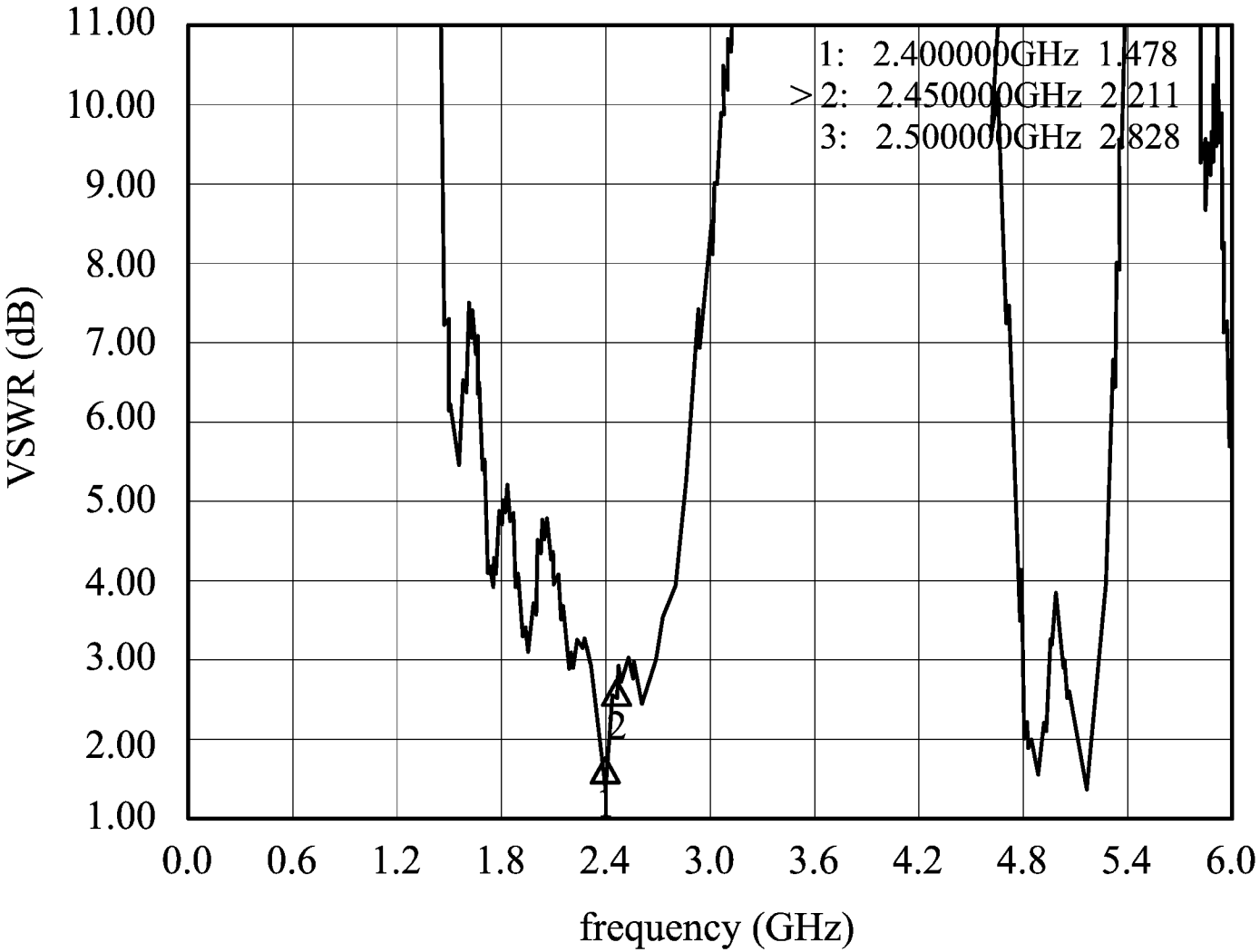
FIG. 4A shows the voltage standing wave ratio of the antenna structure of the second embodiment of the invention.
Figure 4B:
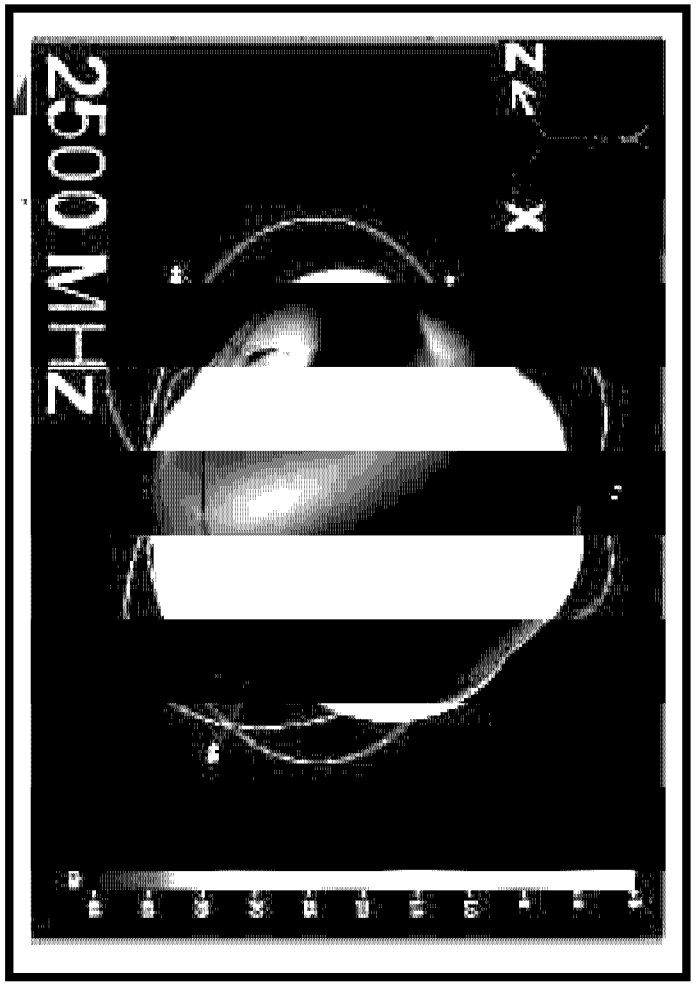
FIG. 4B shows the radiation pattern of the antenna structure of the second embodiment of the invention.
Figure 4C:
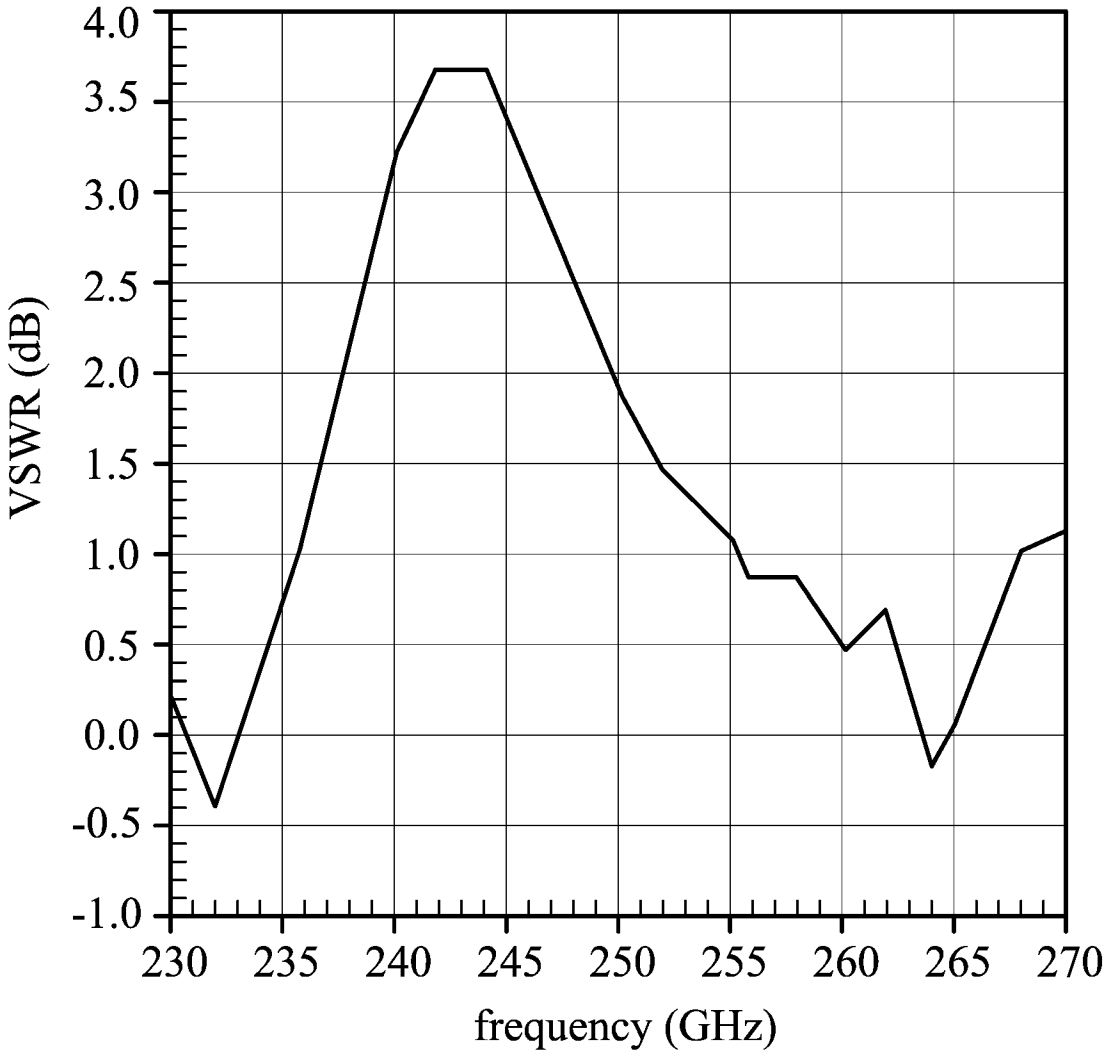
FIG. 4C shows the gain value of the antenna structure of the second embodiment of the invention.

FIG. 4A shows the voltage standing wave ratio of the antenna structure of the second embodiment of the invention. As shown in FIG. 4A, the antenna structure 200 of the embodiment of the invention results in improved NFC test effects in the band of 2.3 GHz~2.7 GHz. FIG. 4B shows the radiation pattern of the antenna structure of the second embodiment of the invention, wherein the antenna structure of the second embodiment results in improved radiation patterns on the Y axis. FIG. 4C shows the gain value of the antenna structure of the second embodiment of the invention, wherein the peak value thereof conforms to the Wireless Fidelity (WIFI) standard.

Figure 5:
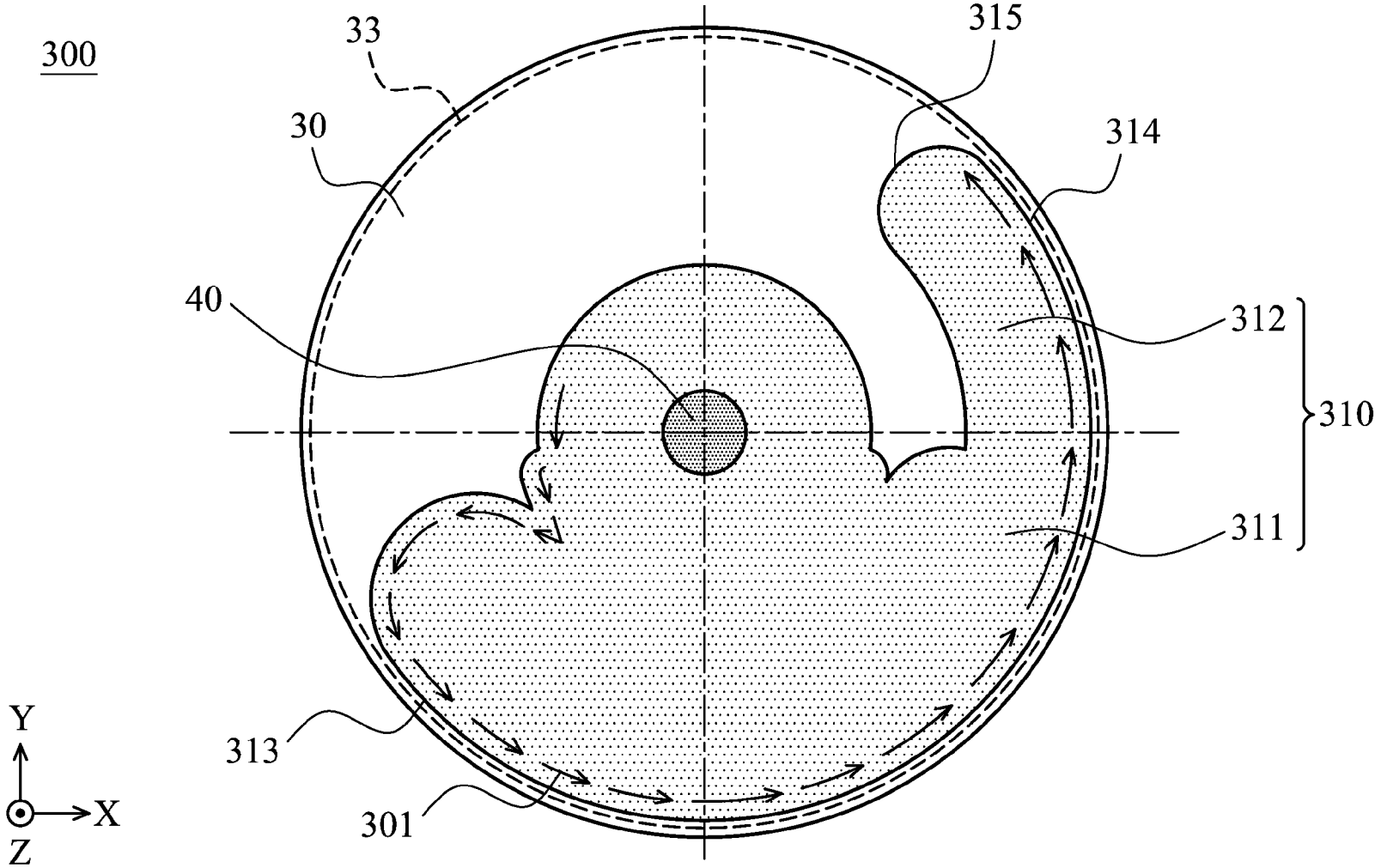
FIG. 5 shows an antenna structure of a third embodiment of the invention.

FIG. 5 shows an antenna structure 300 of a third embodiment of the invention, comprising a substrate 30, a feed point 40, and a radiator 310. The antenna structure 300 transmits a wireless signal. The substrate 30 comprises a circular area 33. The feed point 40 is located at the center of the circular area 33. The radiator 310 surrounds and is coupled to the feed point 40, wherein the radiator 310 comprises a body 311 and a tail portion 312, and the tail portion 312 is connected to the body 311. A surface current 301 travels from the feed point 40, along an edge of a body portion edge 313 of the body 311 and an edge of the tail portion edge 314 of the tail portion 312 to a free end 315 of the tail portion 312. The path length of the surface current 301 is about a quarter of a wavelength of the wireless signal. The edge of the tail portion edge 314 and a portion of the edge of the body portion edge 313 extend along a peripheral of the circular portion 33.

Figure 6A:
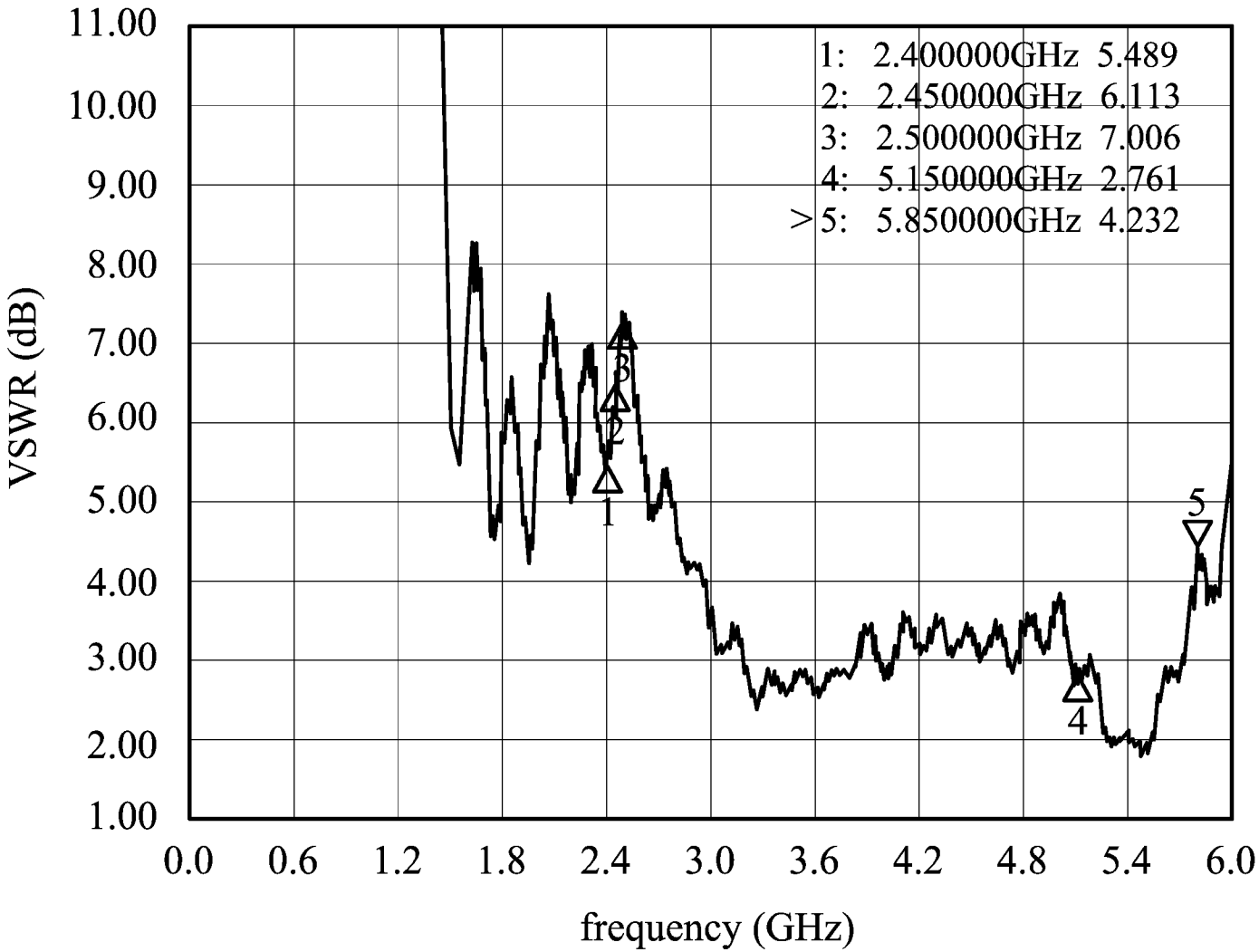
FIG. 6A shows the voltage standing wave ratio of the antenna structure of the third embodiment of the invention.
Figure 6B:
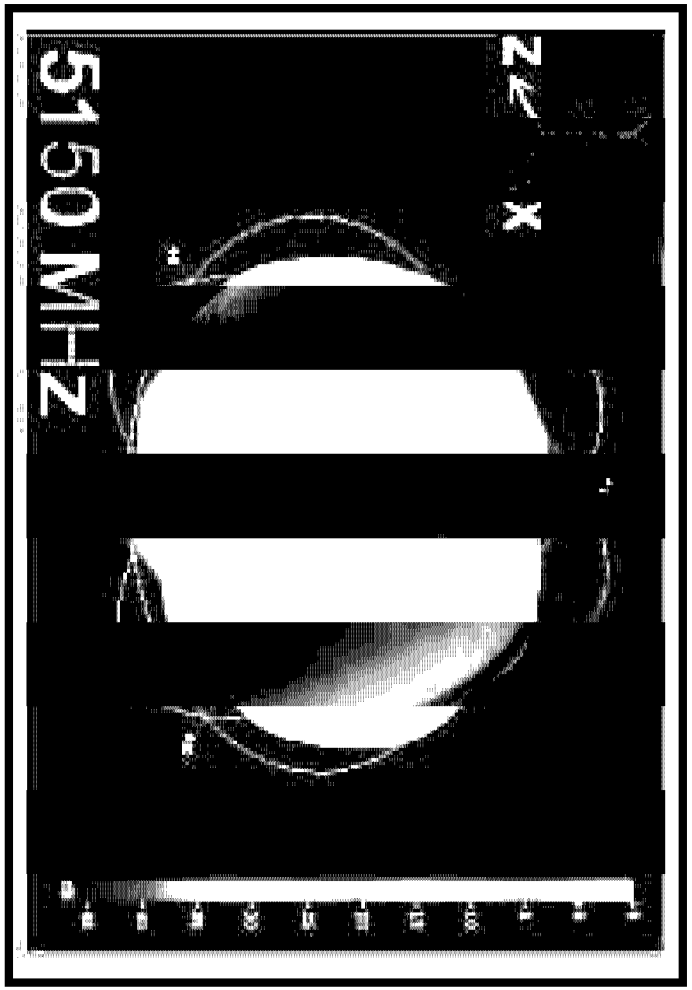
FIG. 6B shows the radiation pattern of the antenna structure of the third embodiment of the invention.

FIG. 6A shows the voltage standing wave ratio of the antenna structure of the third embodiment of the invention. As shown in FIG. 6A, the antenna structure 300 of the embodiment of the invention results in improved NFC test effects in the band of 4.8 GHz~5.8 GHz. FIG. 6B shows the radiation pattern of the antenna structure of the third embodiment of the invention, wherein the antenna structure of the third embodiment results in improved radiation patterns on the Y axis.

Figure 7:
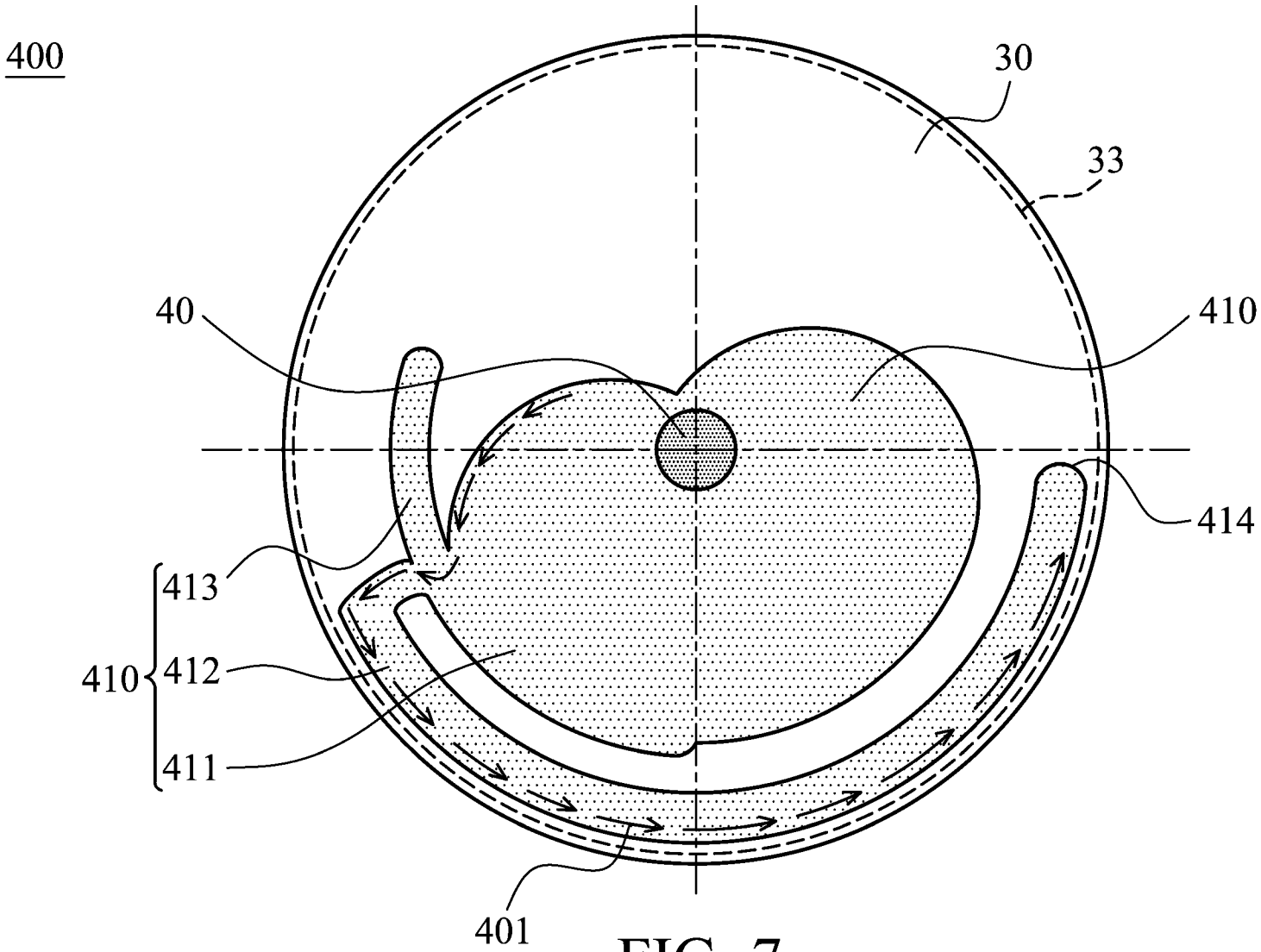
FIG. 7 shows an antenna structure of a fourth embodiment of the invention.

FIG. 7 shows an antenna structure 400 of a fourth embodiment of the invention, comprising a substrate 30, a feed point 40, and a radiator 410. The antenna structure 400 transmits a wireless signal. The substrate 30 comprises a circular area 33. The feed point 40 is located at the center of the circular area 33. The radiator 410 surrounds and is coupled to the feed point 40, wherein the radiator 410 comprises a body 411, a first arm 412 and a second arm 413, and the first arm 412 and the second arm 413 extend from the body 411. The first arm 412 extends along a peripheral of the circular portion 33, and the second arm 413 extends toward a direction opposite to the first arm 412. The second arm 413 is utilized to increase bandwidth of the antenna structure 400. A surface current 401 travels from the feed portion 40 and passes through the body 411 and the first arm 412 to a free end 414 of the first arm 412. The path length of the surface current 401 is about a quarter of a wavelength of the wireless signal. The antenna structure 400 of the embodiment of the invention results in improved NFC test effects in the band of 1.57 GHz~1.62 GHz.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a circular area, comprising a first region and a second region;

a feed point, disposed at a center of the circular area;

a first radiator, coupled to the feed point, and circuitously extending in the first region along a radial direction and a circumferential direction of the circular area; and a second radiator, coupled to the feed point, and circuitously extending in the second region along the radial direction and the circumferential direction of the circular area, wherein the antenna structure is adapted to transmit a high band signal and a low band signal, and the first radiator comprises a high band section, wherein a path length of the first radiator is about a quarter of a wavelength of the low band signal, and a path length of the high band section is about one of eight of a wavelength of the high band signal.

2. The antenna structure as claimed in claim 1, wherein a path length of the second radiator is about a quarter of the wavelength of the high band signal.

3. The antenna structure as claimed in claim 1, wherein the first radiator winds outwardly in one direction in the shape of a semicircular arch centrally about a first swinging center line, and the second radiator winds outwardly in an opposite direction to windings of the first radiator in the shape of a semicircular arch centrally about the first swinging center line.

4. An antenna structure, comprising:

a circular area, comprising a first region and a second region;

a feed point, disposed at a center of the circular area;

a first radiator, coupled to the feed point, and circuitously extending in the first region along a radial direction and a circumferential direction of the circular area; and a second radiator, coupled to the feed point, and circuitously extending in the second region along the radial direction and the circumferential direction of the circular area, wherein the second radiator further comprises a coupling portion, and a line width of the coupling portion is greater than a line width of the first radiator.

5. The antenna structure as claimed in claim 4, wherein the coupling portion extends along a peripheral of the circular portion.

6. The antenna structure as claimed in claim 5, wherein the coupling portion is formed at an end of the second radiator.

7. An antenna structure, comprising:

a circular area, comprising a first region and a second region;

a feed point, disposed at a center of the circular area;

a first radiator, coupled to the feed point, and circuitously extending in the first region along a radial direction and a circumferential direction of the circular area; and a second radiator, coupled to the feed point, and circuitously extending in the second region along the radial direction and the circumferential direction of the circular area, wherein the first radiator comprises a plurality of first bending portions and a plurality of first extending portions, and the first bending portions extend in the radial direction, the first extending portions extend in the circumferential direction, and at least one of the first bending portions connects the neighboring first extending portions.

8. The antenna structure as claimed in claim 7, wherein the second radiator comprises a plurality of second bending portions and a plurality of second extending portions, and the second bending portions extend in the radial direction, and the second extending portions extend in the circumferential direction, and at least one of the second bending portion connects the neighboring second extending portions.

9. The antenna structure as claimed in claim 8, wherein the first region and the second region are semicircular.

10. The antenna structure as claimed in claim 9, wherein the antenna structure is adapted to transmit a wireless signal, and the first radiator is symmetrical to the second radiator.

11. The antenna structure as claimed in claim 10, wherein a length of the first radiator and a length of the second radiator are substantially equal to quarter of a wavelength of the wireless signal.

12. The antenna structure as claimed in claim 10, further comprising a substrate, wherein the circular area is located on the substrate, the first radiator and the second radiator are microstrip structures, and the first radiator and the second radiator extend on the substrate.

* * * * *